United States Patent [19]

Kimberley

[11] 3,964,459

[45] June 22, 1976

[54] UNIVERSAL FUEL INJECTION SYSTEM CONTROLLER

[75] Inventor: John A. Kimberley, East Granby, Conn.

[73] Assignee: Ambac Industries, Inc., Springfield, Mass.

[22] Filed: June 23, 1975

[21] Appl. No.: 589,034

[52] U.S. Cl. ..... 123/140 FG; 123/139 AL; 123/140 R

[51] Int. Cl.[2] ..... F02D 11/06

[58] Field of Search ... 123/140 FG, 140 R, 139 AL, 123/139 AN, 139 AM

[56] References Cited

UNITED STATES PATENTS

| | | | |
|---|---|---|---|
| 3,587,547 | 6/1971 | Hussey et al. | 123/140 R |
| 3,615,043 | 10/1971 | Hussey et al. | 123/139 AM |

*Primary Examiner*—Wendell E. Burns
*Assistant Examiner*—James W. Cranson, Jr.
*Attorney, Agent, or Firm*—Howson and Howson

[57] ABSTRACT

A controller for a diesel engine fuel injection system of the type characterized by an injector for each engine cylinder driven by a variable high pressure "common rail" fluid. The controller generates and regulates the rail pressure, meters the fuel to the injectors, and times the firing of the injectors in accordance with engine requirements. The controller is characterized by a novel ring cam-driven piston pump for generating the high common rail pressure and a novel differential piston regulator for regulating the common rail pressure. The controller further includes a novel metering system for metering the discrete quantities of fuel delivered to the injectors.

13 Claims, 14 Drawing Figures

FIG.3.
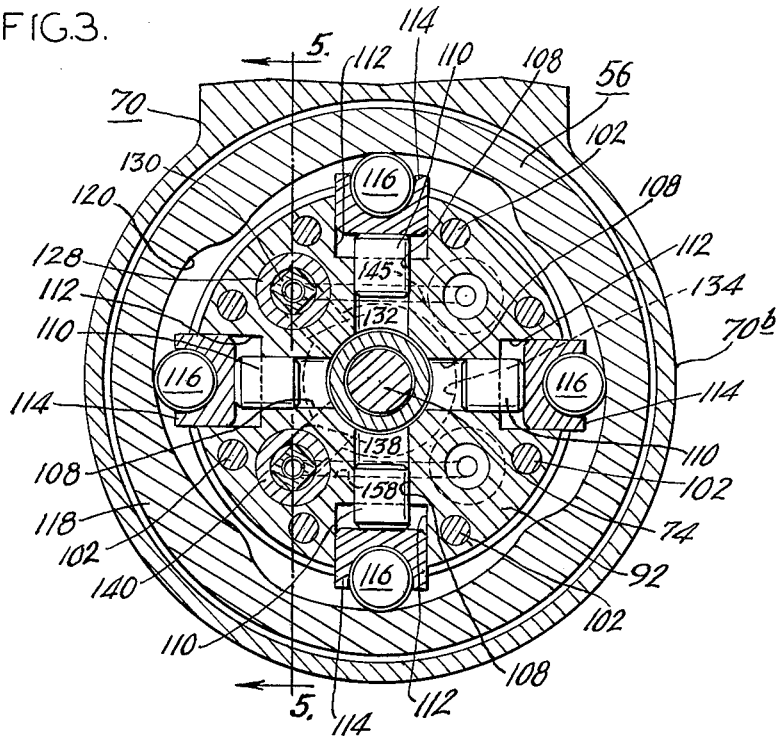
FIG.5.
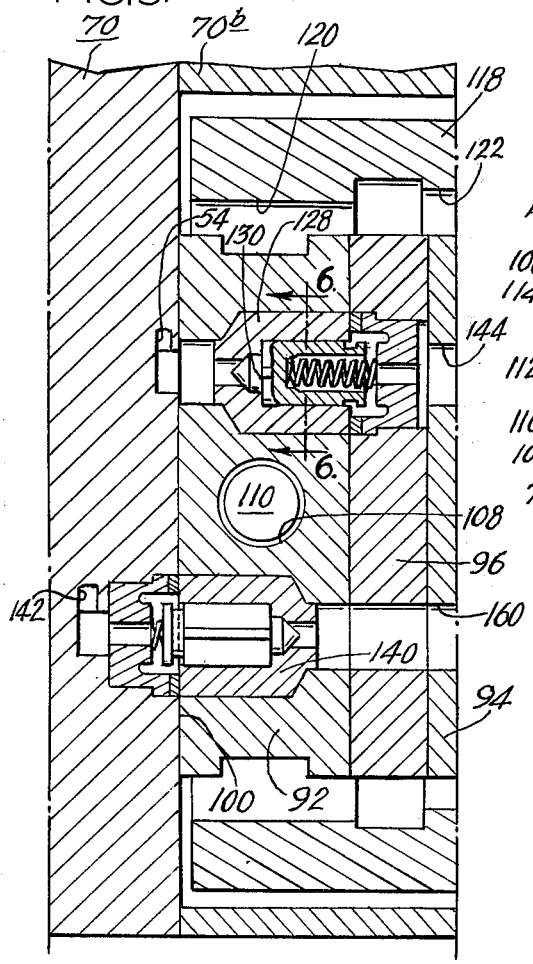
FIG.4.
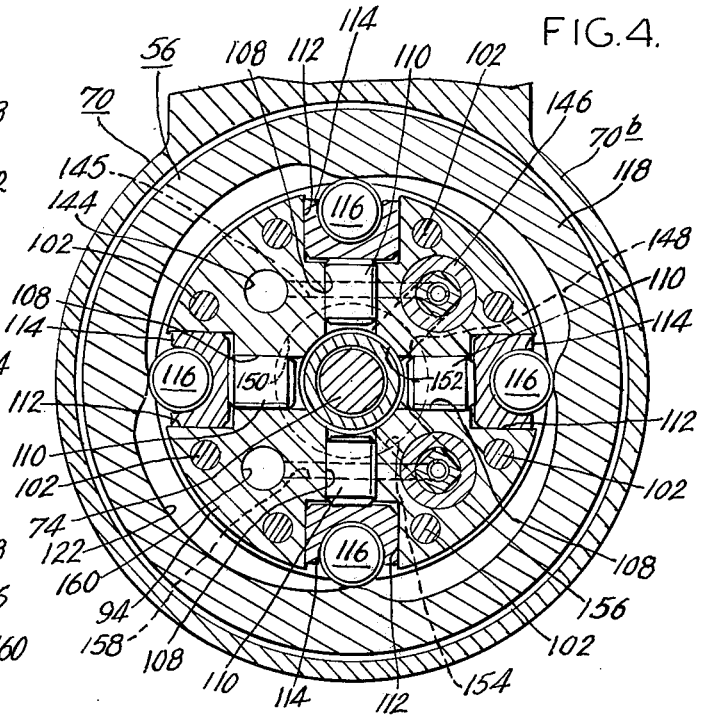
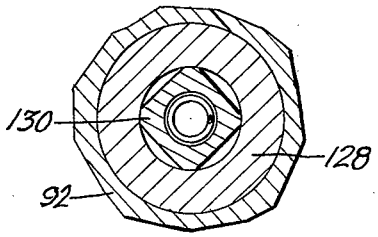
FIG. 6.

UNIVERSAL FUEL INJECTION SYSTEM CONTROLLER

BACKGROUND OF THE INVENTION

The present invention relates generally to fuel injection control devices for diesel type internal combustion engines. The invention is more particularly directed to diesel engine injection systems of the type utilizing a separate injector for each engine cylinder, the injectors being driven by a variable high pressure common rail fluid. The present controller generates and regulates the common rail pressure, meters fuel to the injectors, and times the firing of the injectors.

A universal fuel injection system of the type for which the present invention is particularly adapted is shown in U.S. Pat. No. 3,587,547, assigned with the present application to a common assignee, which patent is hereby incorporated by reference. This patent discloses a fuel injection system wherein a separate fuel injector is employed for each engine cylinder and is supplied with discrete metered quantities of fuel which are discharged therefrom upon actuation by an electrical timing signal. The discharge is hydraulically effected by a high pressure common rail fluid acting on an amplifier piston, the common rail pressure being variable to selectively vary the rate of injection in accordance with engine operating conditions.

In the system described in U.S. Pat. No. 3,587,547, a variable high pressure hydraulic fuel pump is utilized to provide the high common rail fluid pressure. The present invention includes integrally within the controller a novel piston type pump for generating this variable common rail pressure and a novel regulator for controlling the rail pressure in accordance with operating conditions. Also described in U.S. Pat. No. 3,587,547 is a universal fuel metering and distributing apparatus, the preferred form of which was that shown in pending application Ser. No. 805,251, now U.S. Pat. No. 3,615,043 issued Oct. 26, 1971 and assigned with the present application to a common assignee. This patent is also incorporated by reference in view of its relationship to the novel fuel metering and distributing apparatus incorporated into the present controller.

SUMMARY OF THE INVENTION

The present controller comprises within a single housing a low pressure pump and regulator for drawing fuel from the engine tank and controlling its pressure to about 200 psi. A novel high pressure rotary pump is included in the controller to supply the high pressure rail fluid at a pressure varying with engine load. The high pressure pump comprises a plurality of radially arranged pistons which are inwardly driven by internal ring cam surfaces. The output of the high pressure pump and hence the pressure of the common rail injector actuating fluid is dependent upon the fluid input to the pump which is controlled by a novel differential piston regulator. Since fuel is most conveniently utilized as the common rail fluid, the regulator is adapted to control the admission of low pressure fuel to the high pressure pump at a rate which provides the desired common rail pressure in accordance with engine load.

The regulator includes a pair of differential pistons acting in opposed relation against a lever. The ends of both pistons are subjected to the output pressure of the high pressure pump and the resulting unequal force of the pistons is balanced by a spring acting against the lever. The lever position controls the position of a regulator sleeve having a port therein cooperating with the annulus of an internal piston to regulate flow of low pressure fuel to the high pressure pump. The axial position of the piston within the sleeve is controlled by a cam arrangement associated with the governor fuel control rod position and as a result the regulator fuel flow and thus the piston pump output pressure will vary as a function of engine load.

The controller includes a fuel metering and distributing means having novel features. A rotating cylindrical distributor includes fuel feed passages for alternatively introducing low pressure fuel into the opposite ends of one or more metering cylinders within which a shuttle sleeve is slidably disposed. A selectively axially adjustable control piston is coaxially disposed within said shuttle sleeve and includes an axial passage at one end thereof opening into an annulus. The annulus cooperates with a transverse port and annulus of the shuttle sleeve to limit the stroke of the shuttle piston and hence the fuel quantity metered during each stroke. The length of the shuttle stroke is governed by adjustment of the axial position of the control piston. The position of the control pistons is regulated as the fuel requirements of the injectors changes by means of a thin wire extending axially through one end of the metering cylinder and connected with the governor fuel control rod. The fuel metered by the shuttle sleeve is delivered through passages in the distributor to the fuel injectors in the proper sequence.

The controller includes an injection timing device of a type known per se utilizing a rotating shutter which cooperates with a fixed light source and photosensitive detector. The shutter is attached to the rotating distributor to coordinate the injection timing and fuel distribution in phase with the engine rotation.

In view of the foregoing, it is accordingly a primary object of the present invention to provide a fuel controller for a diesel fuel injection system of the type characterized by a separate injector for each engine cylinder driven by a variable high pressure common rail fluid.

A further object of the invention is to provide a controller as described which generates and regulates the variable high common rail pressure, meters fuel to the injectors, and times the firing of the injectors in accordance with the engine requirements.

Another object of the invention is to provide a controller as described which incorporates a novel high pressure pump and regulator for providing a variable common rail pressure in accordance with engine load.

Still another object of the invention is to provide a controller as described which includes a novel type of fuel metering device.

Additional objects and advantages of the invention will be more readily apparent from the following detailed description of an embodiment thereof when taken together with the accompanying drawings.

BRIEF DESCRIPTION OF THE DRAWINGS

FIG. 3 is a partial sectional view taken along line 3—3 of FIG. 2 showing details of the high pressure pump;

FIG. 4 is a partial sectional view taken along line 4—4 of FIG. 2 showing additional details of the high pressure pump;

FIG. 5 is an enlarged partial sectional view taken along line 5—5 of FIG. 3;

FIG. 6 is an enlarged sectional view taken along line 6—6 of FIG. 5;

DESCRIPTION OF THE PREFERRED EMBODIMENT

The present controller as indicated above is especially adapted for use with the "universal" fuel injection system of the type shown in U.S. Pat. No. 3,587,547 wherein each cylinder of a diesel engine is equipped with a separate injector which is driven by a variable high common rail fluid, preferably the engine fuel. Metered quantities of fuel are supplied to each injector and the injection is timed by an electrical signal which through a solenoid valve and a servo valve initiates the injection of the metered fuel.

Figure 1:
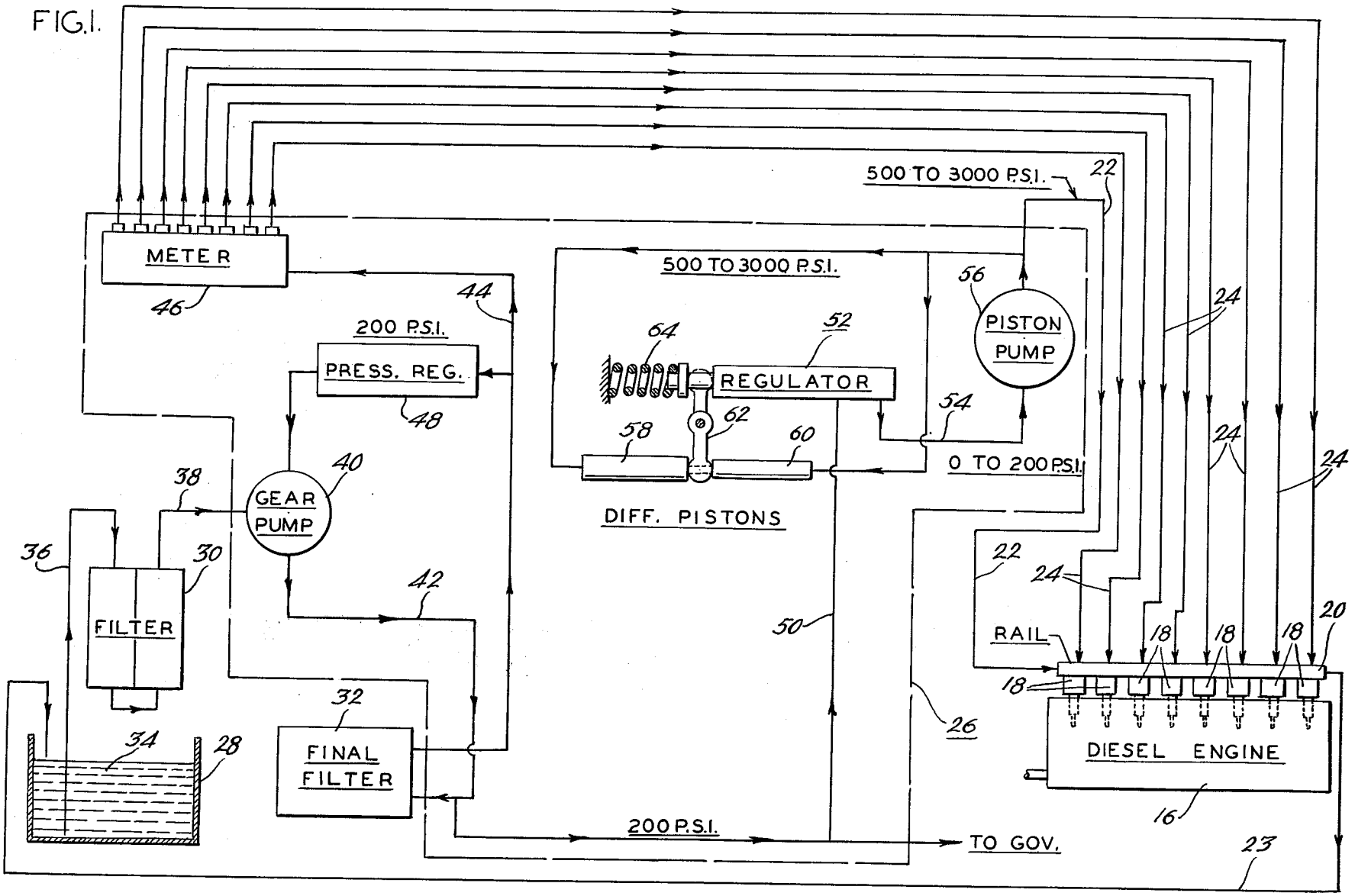
FIG. 1 is a schematic diagram of a fuel injection system incorporating the present controller, the elements within the broken line closure comprising the important elements of the controller.

In the schematic showing of FIG. 1, a diesel engine 16 is provided with a plurality of injectors 18 of the type described, there being one injector for each engine cylinder, in this case a total of eight. The injectors are each connected with a common rail 20 which is supplied with fuel at a pressure varying between 500 to 3,000 psi by a conduit 22. The injectors 18 are supplied with metered quantities of fuel in the proper phase with engine operation through conduits 24. High pressure fuel that has been used to drive the injectors is returned at low pressure to tank 28 through conduit 23.

In the showing of FIG. 1, the fuel controller generally designated 26 in accordance with the present invention is shown as a broken line irregular box within which the main components of the controller are schematically represented. Aside from the fuel tank 28, filter 30 and the final filter 32, the controller incorporates all of the elements necessary to pump, meter and regulate the timing and rate of input of fuel to the engine in accordance with the demand therefor as signaled by the engine governor in response to engine load and throttle setting. In view of the somewhat complex structure of the controller embodiment illustrated in FIGS. 2–14, a summary description of the basic components of the controller is presented in connection with the schematic showing of FIG. 1. The identifying numbers used in the summary described are also used in the detailed description of the preferred embodiment as set forth below.

The diesel fuel 34 in tank 28 passes through conduit 36, filter 30, and conduit 38 into gear pump 40 within the controller 26. The output of the gear pump flows through passage 42 to a final filter 32 which is located outside of the controller 26 to facilitate change of the filter element. The filtered fuel flows through passage 44 to the fuel metering and distributing means 46 contained within the controller. Pressure regulator 48 regulates the output pressure of the gear pump to approximately 200 psi. The metered fuel passing from the metering and distributing means 46 is led to the injectors 18 through the conduits 24.

Fuel from the gear pump 40 also flows through a passage 50 into a regulator 52 from which the fuel at a regulated pressure passes through a passage 54 to a high pressure piston pump 56, the output of which is delivered to conduit 22 to provide the high common rail pressure. Since the output pressure of piston pump 56 is directly proportional to the fuel input thereto, assuming a constant demand by the injectors, and hence to the pressure in passage 54, the regulator 52 by varying the input pressure into the piston pump controls the piston pump output pressure. The regulator 52 includes differential pistons 58 and 60, the opposite ends of which are each subjected to the output pressure of the piston pump 56. The differential pistons act upon a lever 62 along with a spring 64 which balances the force of the pistons. The lever 62 will accordingly at a given piston pump output pressure be positioned by the pistons and spring at a predetermined position. Any increase or decrease in the pump output pressure will accordingly reposition the lever 62 and in a manner explained below increase or decrease the output pressure at line 54. The regulator 52 automatically varies the pressure in line 54 in accordance with engine load and consequently varies the piston pump output pressure in accordance with engine load.

Figure 2:
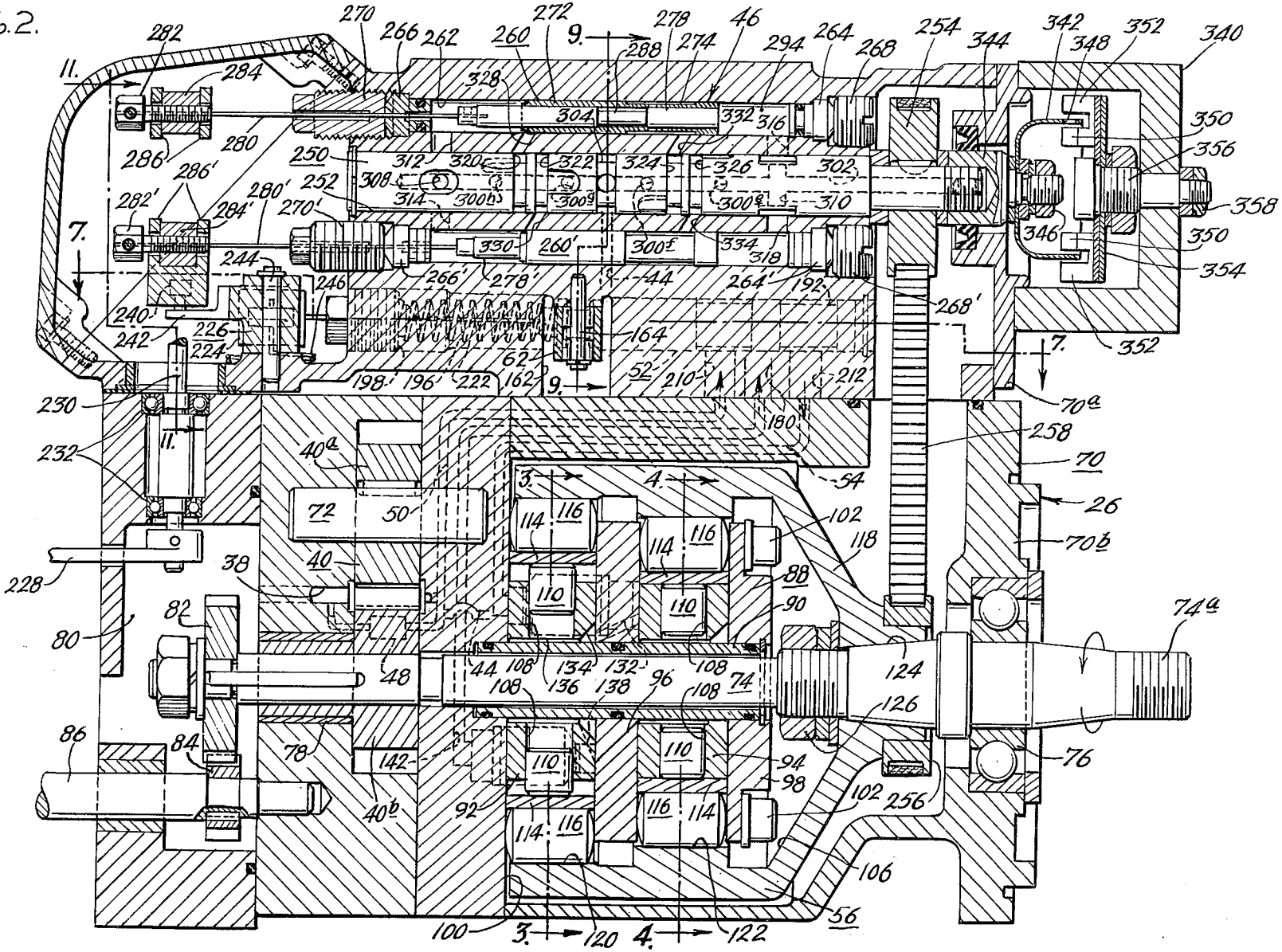
FIG. 2 is a vertical longitudinal sectional view taken through a fuel injection controller in accordance with the present invention.

Consdering in detail the specific embodiment of the invention shown in FIGS. 2–14, and with specific reference to FIG. 2, the controller broadly designated 26 is enclosed within a housing 70 of an irregular configuration which includes an upper housing section 70*a* and a lower housing section 70b. Contained within the lower housing section 70*b* are the low pressure gear pump 40 and the high pressure piston pump 56. The upper housing section 70*a* includes the regulator 52, the fuel metering and distributing device 46 and the injection timing device. To simplify the disclosure, the structure of the elements within the lower housing section 70*b* will first be considered, although it will be apparent that the operation of this structure is closely related to and dependent on the operation of the components in the upper housing section.

The low pressure pump 40 as shown in FIG. 2 is a conventional gear type pump comprising an upper gear 40*a* keyed to and rotating with the shaft 72 journalled within the housing, and a lower gear 40*b* cooperatively meshing with the gear 40*a*. The lower gear 40*b* is keyed to the controller main shaft 74 which is supported by the bearing assembly 76 at the righthand end of the housing section 70*b* and by bushing 78 adjacent the low pressure pump. The shaft 74 at its righthand end is threaded at 74*a* for connection to the engine and in the embodiment illustrated is adapted for rotation at one half engine speed.

The gear pump 40 receives fuel from the tank 28 through conduit 38 and the fuel passes between the pumping lobes of the gears 40a and 40b in a well known manner. The fuel output of the gear pump in conduit 42 is regulated to a pressure of approximately 200 pounds by a pressure regulator 48 which appears in FIG. 2 only in broken lines. The output of the low pressure pump 40 is divided, a portion passing through conduit 50 upwardly into the regulator 52 and thence upon regulation thereby returning through conduit 54 and passing into the high pressure pump 56. A second portion of the flow from the low pressure pump 40 passes outside of the housing as indicated at 42*a* to the final filter 32 (shown only in FIG. 1) and returns through conduit 44 in the upper housing section 70*a* for metering and distribution to the injectors. A third portion of the low pressure fuel flow passes as indicated in FIG. 1 to the engine governor.

The lefthand end of the shaft 74 extends into a cavity 80 within the lower housing section 70*b* and carries on the end thereof a gear 82 which drives a smaller gear 84 on the governor drive shaft 86 connected to the engine governor (not shown).

The high pressure piston pump 56 as shown in FIGS. 2–5 comprises a substantially cylindrical pump housing assembly 88 fixed to the housing section 70*b* in coaxial relation to the main controller shaft 74 which passes in spaced relation through a sealed sleeve 90 therewithin. For convenience in fabrication, the housing 88 is formed of essentially four hollow cylindrical members including the pump cylinder defining members 92 and 94, the spacer 96 therebetween, and the cap member 98 at the outer end thereof. The pump housing members 92, 94, 96 and 98 are secured together and to the controller interior housing wall 100 by a plurality of bolts 102 and are disposed within a cavity 106 within the lower housing section 70*b*.

As shown in FIGS. 3 and 4, the housing members 92 and 94 each include four radially directed piston cylinders 108 therein which are spaced at 90° intervals. Pistons 110 are disposed for recipricatory radial movement within the cylinders 108. Enlarged outer bores 112 coaxial with the cylinders 110 receive the tappets 114 and rollers 116 which actuate the pistons 110. A rotating pump cam 118 includes inner cam surfaces 120 and 122 which respectively engage the rollers 116 of members 92 and 94. The cam 118 is secured to a tapered section 124 of the main shaft 74 for rotation therewith by a nut 126.

The cam surfaces 122 and 124 each include four identical cam patterns, the patterns repeating every 90° with the result that the four pistons of each housing member 92 and 94 are simultaneously driven inwardly by the engagement of the cam surfaces with the rollers 116. Each revolution of the main shaft 74 will accordingly produce four pumping strokes from each of the pistons. The piston groups of the members 92 and 94 are axially aligned but the cam surfaces 120 and 122 are 45° out of phase so that the pumping strokes of the pistons in member 94 will take place between the pumping strokes of the pistons of the member 92. There will accordingly be a total of eight pumping strokes during each revolution of the main shaft, four by the pistons of the member 92, and four by the pistons of member 94, resulting in a pumping stroke every 45°.

The fuel flow through the pump 56 involves a series of passages, chambers and check valves. The fuel flows into the pump through passage 54 from the regulator 52 and as shown in FIG. 5 passages through a check valve 128 of a conventional construction having a spring loaded valve member 130, a cross section of which is shown in FIG. 6. The fuel flows inwardly from passage 54 through check valve 128 only when the pressure in the passage 54, which will vary between 0 and 200 psi, is greater than the pressure on the other side of the check valve 128. The check valve 128 opens into a radial passage 132 (FIGS. 2 and 3) in spacer member 96 which in turn opens into a conical cavity 134 communicating by means of annular slot 136 between the sleeve 90 and member 92 with the four cylinders 108 of the member 92. All of the cylinders are thus in fluid communication and the compression chamber includes the cavity 134 and annulus 136 in addition to the cylinders 108. The pumping output of the pistons of member 92 passes from the cavity 134 through passage 138 (FIGS. 2 and 3) in member 92 to a check valve 140 which connects with a passage 142 in the lower housing section 70b. The check valve 140, which is identical in construction with the check valve 128, opens when the pressure within the passage 138 exceeds the pressure within passage 142, essentially during the pumping strokes of the pistons 110.

The fuel flow into and from the piston-cylinders of member 94 is similar to that described above, passages 144 and 145 connecting with passage 132 to direct fuel into a check valve 146 within member 92. A passage 148 from check valve 146 delivers the fuel into a conical chamber 150 and annulus 152 which are identical with the chamber 134 and annulus 136 of the member 92. During the pumping stroke of the pistons 110 of member 94, the pumped fuel passes through a passage 154 in the member 94 to a check valve 156 which permits passage of the high pressure fuel through a transverse passage 158 to an axial passage 160 communicating with check valve 140. The check valves 146 and 156 accordingly play the same role with respect to the pumping pistons of member 94 as do the check valves 128 and 140 with respect to the pistons of member 92.

The inward pumping stroke of the pumping pistons 110 is as described caused by the engagement of the rollers 116 with the cam surfaces of cam 118. The outward movement of the pistons, however, is caused by the flow of low pressure fuel from the regulator 52 through the check valves 128 and 146 into the cylinders. Should the regulator restrict the flow of fuel into the pump 56, the pistons 110 may not return to their radially outermost position and the output volume of the pump and hence the pressure in the common rail 20 will be reduced. Should the input from the regulator drop to 0, the pistons will not move away from their radially innermost position as shown in FIG. 4 and there will be no fuel output from the piston pump until the regulator admits low pressure fuel through the conduit 54. Since the regulator correlates the common rail pressure with engine load, it can be understood that by variation of the pressure input to pump 56, the common rail pressure can be controlled in accordance with engine operating conditions.

Figure 7:
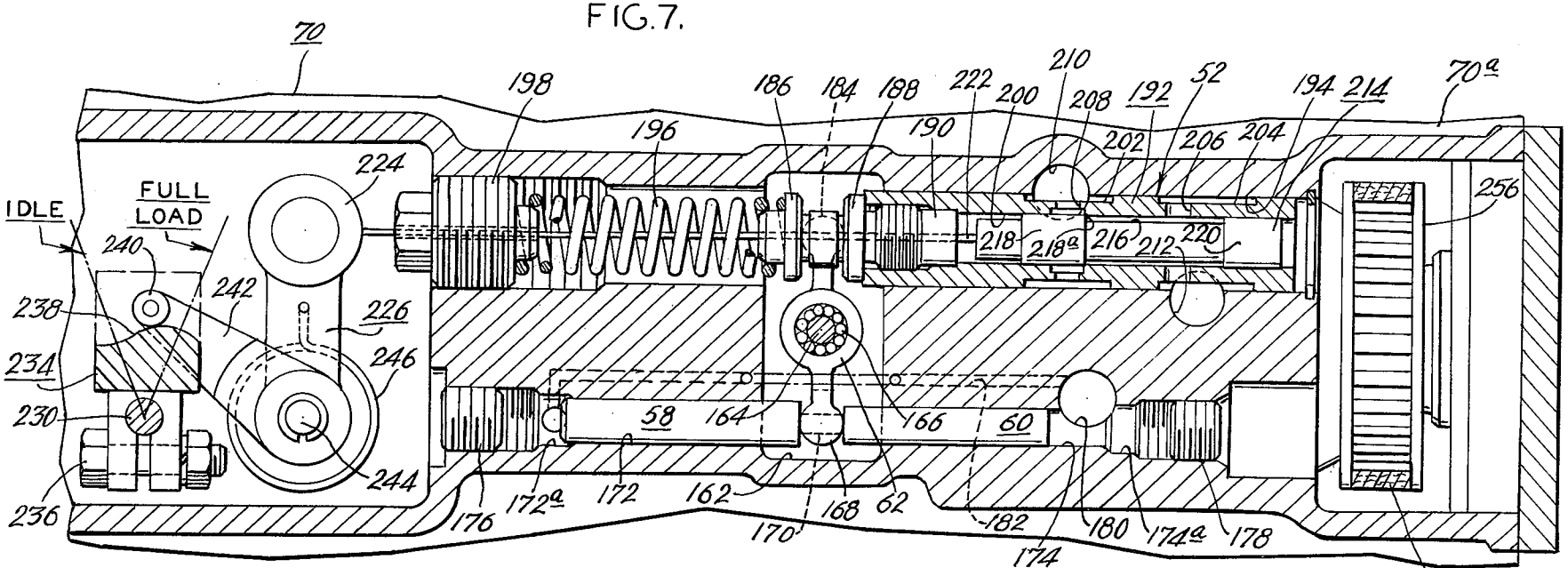
FIG. 7 is an enlarged partial sectional view taken along line 7—7 of FIG. 2 and showing details of the high pressure pump regulator.
Figure 8:
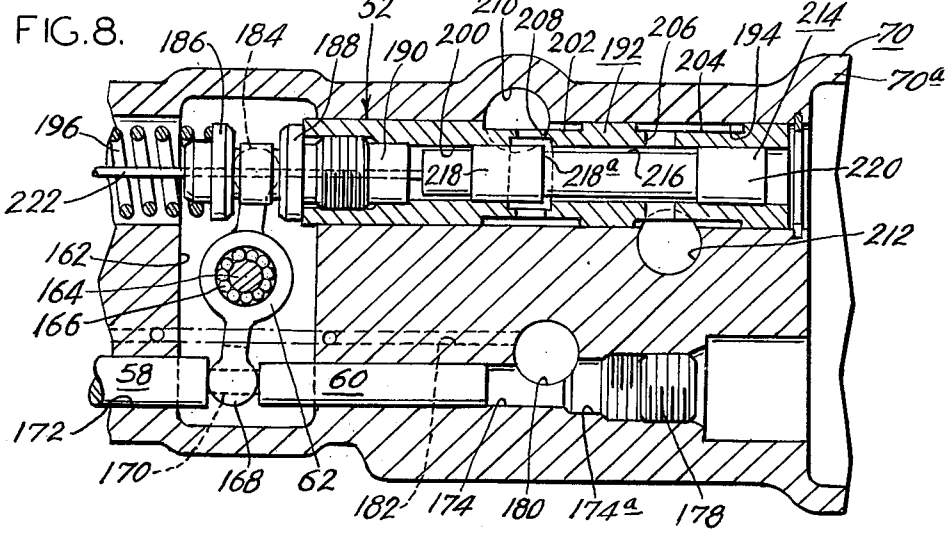
FIG. 8 is a view of a portion of the regulator as shown in FIG. 7 with the regulator components in a different position.
Figure 9:
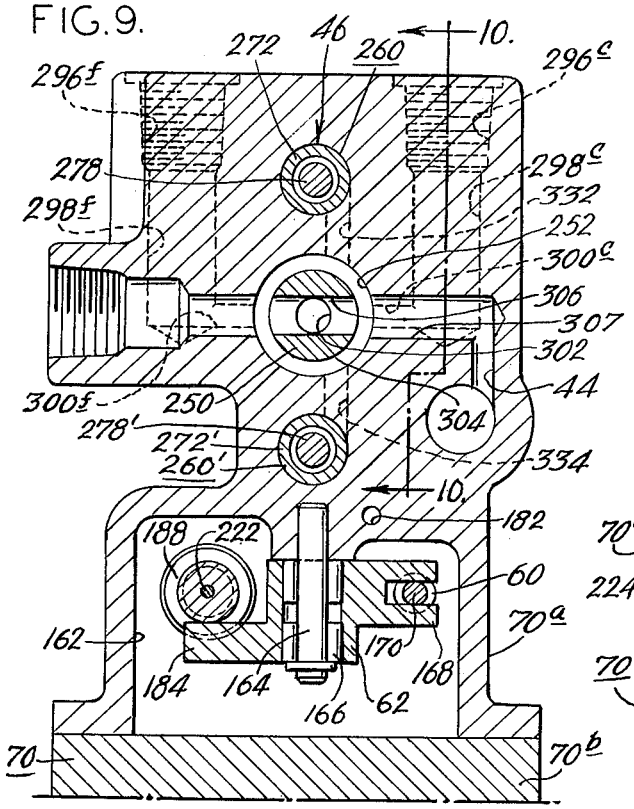
FIG. 9 is an enlarged partial sectional view taken along line 9—9 of FIG. 2 and showing details of the fuel metering and distributing means.

The structure of regulator 52 as shown in FIGS. 2, 7 and 8 includes the lever 62 shown in the schematic view which is disposed within a cavity 162 of the upper housing section 70*a*. The lever 62 is centrally pivotally supported on a vertical shaft 164 by the needle bearing assemblies 166. A bifurcated end 168 of the lever 62 as shown in FIG. 9 straddles the necked down portion 170 of the member defining the differential pistons 58 and 60 which are respectively slidably disposed within bores 172 and 174 of the upper housing section 70*a*. Enlarged end portions 172*a* and 174*a* respectively of the cylindrical bores 172 and 174 are provided with threaded plugs 176 and 178 to form closed chambers at the opposite ends of the differential pistons 58 and 60. The variable high pressure fuel from the piston pump 56 passes through passage 142 in the lower housing section 70*b* into a vertical passage 180 in the upper housing section 70*a* which opens into the chamber 174*a*. An auxiliary passage 182 connects the passage 180 with the chamber 172*a* to introduce fuel at the variable common rail pressure at opposite ends of the differential pistons 58 and 60. In view of the fact that the piston 58 is of a slightly larger diameter than the piston 60, the pistons as viewed in FIG. 7 will produce a force toward the right on the end 168 of lever 62, which force is dependent on the common rail pressure level.

The end 184 of lever 62 opposed from end 168 is disposed between spaced shoulders 186 and 188 of regulator member 190 which is threadedly secured to a regulator sleeve 192. The sleeve 192 is slidably disposed within a bore 194 of the upper housing section 70*a*. One end of the compression spring 64 bears axially against the shoulder 186 of member 190 and the other end bears against a threaded stop 198 within bore 194. The spring 196 accordingly opposes the rotational force supplied by the differential pistons to the lever 62, and the lever and the regulator sleeve 192 will assume a predetermined position for any given output pressure of the high pressure pump 56. The sleeve position will vary with variation in the output pressure of pump 56, a greater pressure causing a compression of the spring 196 and a movement of the sleeve to the left, while a lesser pressure will result in a shaft of the sleeve toward the right as viewed in FIG. 7.

The regulator sleeve 192 includes a coaxial bore 200 and a pair of axially spaced external annuli 202 and 204 which respectively communicate with the bore 200 by means of axial ports 206 and 208. A low pressure fuel inlet port 210 receives fuel from low pressure gear pump 40 through conduit 50 and communicates at all times with the annular 202 of the regulator sleeve 192. A regulated fuel outlet port 212 in the upper housing section 70a similarly communicates at all times with the annulus 204 of the regulator sleeve 192. The port 212 as shown in FIG. 2 communicates with the passage 54 carrying the low pressure fuel into the high pressure piston pump 56.

Within the bore 200 of the regulator sleeve 192, a regulator piston 214 is slidably disposed and includes an annulus 216 disposed between lands 218 and 220. A control wire 222 connected to one end of the piston 214 passes through a coaxial bore in member 190, centrally through spring 64, and through a coaxial bore in stop element 198. The outer end of the wire 222 is attached to one end 224 of a lever 226 for movement in accordance with engine load in a manner to be presently described.

The annulus 216 of the piston 214 is at all times in communication with the port 206 of the regulator sleeve 192 and hence the fuel output port 212. A variable area annular flow regulating orifice is formed adjacent the shoulder 218a where the annulus 216 meets the land 218 of the piston. With the sleeve 192 positioned as shown in FIG. 7, flow from port 210 and port 208 into the annulus 216 is blocked by the land 218 of the piston 214. However, as shown in FIG. 8, when the sleeve 192 is moved to the right due to a drop in the common rail pressure, the land 218 no longer blocks the port 208 and fuel can flow from port 210 through port 208 into annulus 216 of the piston and thence through ports 206 into the output port 212. The rightward movement of the sleeve 192 as viewed in FIGS. 7 and 8 will accordingly permit an increased flow of the low pressure fuel to the high pressure pump 56, while a leftward movement of the sleeve 192 will result in a diminished or halted flow of the fuel. It may accordingly be seen that if the regulator piston 214 is moved toward the left as viewed in FIG. 7, the output pressure of the high pressure pump 56 required to overcome the force of spring 196 to move the sleeve to a corresponding leftward balance position increases. The lever 226 is accordingly arranged as described below to move the wire 222 to the left with increasing engine load, and to the right with decreasing engine load to cause the common rail pressure to correspondingly increase or decrease.

Figure 11:
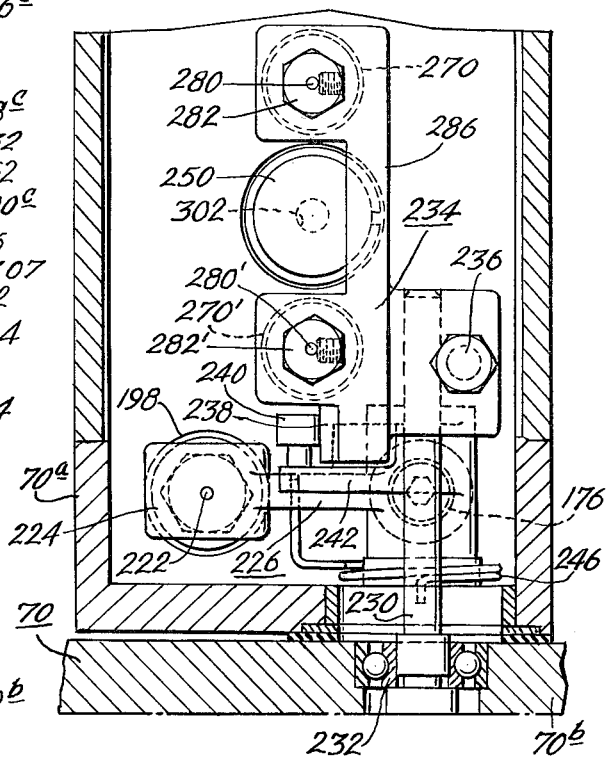
FIG. 11 is a partial sectional view taken along line 11—11 of FIG. 2 and showing the connection of the fuel metering shuttle sleeves and the regulator piston with the governor fuel control.

The manner in which the lever 226 and hence the regulator piston 214 is moved in accordance with engine load is best illustrated in FIGS. 2, 7 and 11. The fuel control rod 228 from the governor is connected with a vertical shaft 230 journalled in bearing assemblies 232. The fuel control rod 228 is connected to the shaft 230 so as to rotate the shaft 230 in a clockwise direction as viewed in FIG. 7 to signal an increase in fuel delivery, and counterclockwise for a decrease in fuel delivery. As shown in FIG. 7, a yoke 234 is clamped to the shaft 230 by bolt 236. The yoke includes thereon a cam surface 238 against which bears a cam follower 240 of a lever arm 242 which is connected in fixed angular relationship to the lever 226. The lever 226 and arm 242 are rotatably mounted on the vertical pin 244 as shown most clearly in FIG. 2. A torsion spring 246 secured to the upper housing section 70*a* biases the lever 226 in a counterclockwise direction as viewed in FIG. 7 and accordingly maintains the cam follower 240 in engagement with the cam surface 238.

As shown in FIG. 7, the rotation of the shaft 230, the position of which is indicative of the engine fuel demand and hence engine load, establishes the position of the arm 226 and hence the regulator piston 214. With the fuel control in the indicated idle position, the arm 242 and lever 226 and rotated by the cam surface 238 to their full clockwise rotation limit. The piston 214 will accordingly be moved to its extreme righthand position, resulting in a diminution or possibly a cutoff of low pressure fuel to the pump 56 until the common rail output pressure drops to a degree counterbalancing the force of spring 196 with the control sleeve 192 positioned in a balanced position with respect to the piston 214 such as shown in FIG. 7. A rotation of the shaft 230 in a clockwise direction toward the indicated full load position will result in a counterclockwise movement of the arm 242 and lever 236 and produce a leftward movement of the control piston 214, thereby opening the flow passage through port 208 and the annulus 216. The fuel delivery to the pump 56 will accordingly increase and the pump ouput pressure likewise increase until the differential pistons have moved the lever 62 against the increased force of spring 196 to return the control sleeve 192 to a balanced position. By this means it can accordingly be seen that the output pressure of the pump 56 will by operation of the regulator 52 produce a common rail output pressure of the pump commensurate with engine load.

The fuel metering and distributing devices generally designated 46 in the schematic view of FIG. 1 are located in the upper portion of the upper housing 70*a* as shown in FIGS. 2, and 9–14. A cylindrical distributor 250 is rotatably disposed within a bore 252 of the upper housing section 70*a* and is rotated therein for a four cycle engine at one half engine speed. For a two cycle engine, the distributor 250 should be rotated at engine speed. The means for rotating the distributor at the correct speed and in phase with the engine rotation comprises a timing belt drive assembly including a timing belt sheave 254 mounted at one end of the distributor 250, a timing belt sheave 256 mounted on the cam 118 on main shaft 74, and timing belt 258 connecting the sheaves 254 and 256. Since the main shaft 74 as indicated above is in the illustrated embodiment driven at one half engine speed, the sheaves 254 and 256 are of the same diameter to produce a rotation of the distributor 250 at one half engine speed.

The distributor 250 is disposed between upper and lower shuttle metering assemblies 260 and 260′. In view of the identity of constructions of these assemblies, the same identifying numerals will be utilized with the addition of a prime suffix to the elements of the lower assembly. The shuttle meter assembly 260 includes a bore 262 in the upper housing section 70*a* parallel to and spaced above distributor bore 252. The lower shuttle meter assembly 260′ is similarly disposed within bore 262′ parallel to and spaced below the distributor bore 252. The detailed description of the shuttle metering assemblies will continue only with respect to the assembly 260, it being understood that the assembly 260′ includes identical structural details.

Plugs 264 and 266 are respectively secured by screws 268 and 270 to seal the ends of the bore 262. A hollow fuel metering shuttle sleeve 272 is slidably disposed within bore 262 and includes an annulus 274 around its external cylindrical surface and transverse ports 276 connecting the annulus with the shuttle sleeve bore. Within the shuttle sleeve 272, a fuel control piston 278 is disposed in slidable relative relation to the shuttle. A control wire 280 attached at one end of the control piston 278 extends slidably through the plug 266 and screw 270 and terminates within the adjusting screw 282 threaded within block 284 of arm 286 of the yoke 234. The control piston 278 will accordingly be moved axially within the bore 262 in response to the fuel demands of the engine. As the shaft 230 is rotated in a clockwise direction toward the full load position, the control piston 278 will be moved toward the right as viewed in FIGS. 2, 12 and 13. A reduction in the desired fuel delivery will produce a movement of the control piston 278 to the left.

The control piston 278 is of a solid cylindrical construction and includes an annulus 288 which communicates by means of transverse bore 290 with an axial bore 292 extending to the righthand end of the piston. It will accordingly be apparent that when the ports 276 of the shuttle 272 are in communication with the annulus 288 of the control piston 278, that the annulus 274 of the shuttle will then be in communication with the chamber 294 at the righthand end of bore 262 formed by the bore 262, the plug 264, and the shuttle 272 and control piston 278.

As indicated above, the shuttle metering assembly 260′ is identical with the structure described with respect to the assembly 260. The control piston 278′ is positioned by the control wire 280′ connected to screw 282′ threadedly engaged in block 284′ of the arm 286′ of yoke 234.

Figure 10:
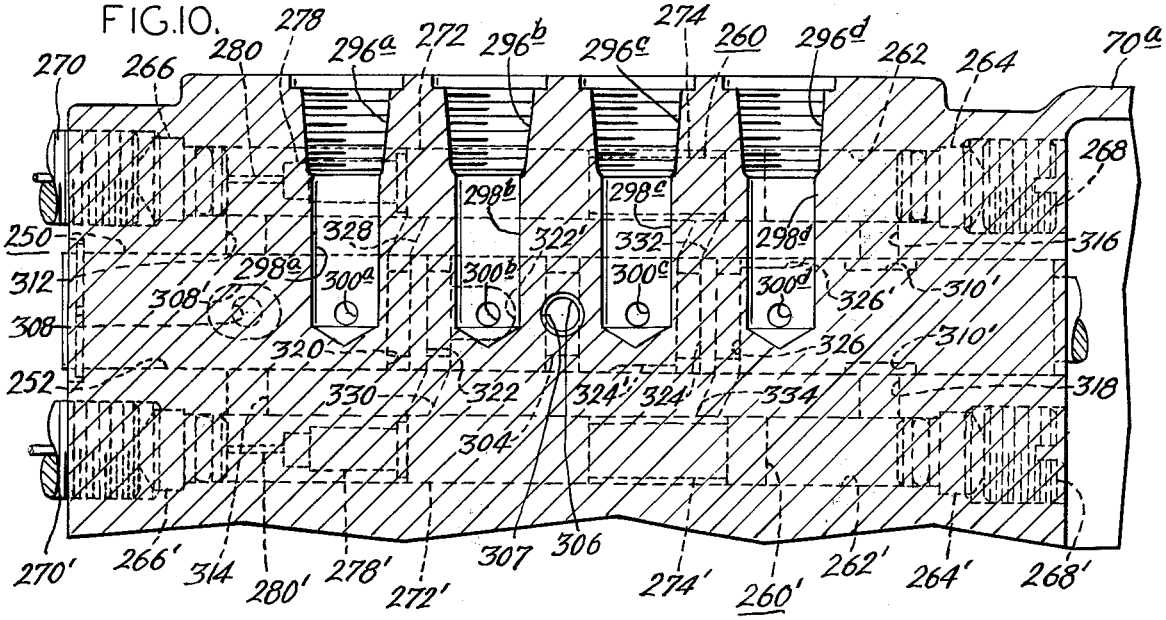
FIG. 10 is a partial sectional view taken along line 10—10 of FIG. 9.

The function of the fuel distributing and metering means is to sequentially provide metered quantities of fuel to the engine injectors 18 through the conduits 24. The conduits 24 connect with threaded ports 296*a–h* opening from the top of the upper housing section 70*a* as shown in FIGS. 9 and 10. The ports 296*a–h* connect with vertical passages 298*a–h* which in turn open into transverse passages 300*a–h* as shown in broken lines in FIG. 9. The passages 300*a–h* open into the distributor bore 252 at spaced intervals. There are two rows of ports 296*a–d* and 296*c–h* parallel to and horizontally spaced from the axis of the distributor 250, and there are thus four passages 300*a–d* and 300*c–h* opening into the distributor bore 252 on opposite sides of the bore 252, which passages are disposed in opposing alignment. Although it is obvious that the proper connection of the ports 296*a–h* with the injectors 18 to provide the proper sequence of metered fuel delivery is critical to the operation of the engine, there is no need in the present specification to go into the details concerning the firing order of the engine. Suffice it to say that it is recognized tha each of the passages 300*a–h* must be supplied with a metered quantity of fuel in a certain sequence and in a certain phase relationship with the rotation of the distributor and the engine. Since the operation of the distributor and metering shuttle assemblies is essentially repetitive, the description will be directed to the manner of metering and distribution of fuel to two of the eight injectors.

The distributor 250 includes a central coaxial bore 302 which is closed at each end and which communicates with a central annulus 304 by means of transverse passage 306. As shown in FIG. 9 and schematically in FIGS. 1 and 2, fuel from the final filter 32 passes into the upper housing section 70*a* through a passage 44 and into a transverse passage 307 communicating with the distributor annulus 304 and hence the distributor bore 302. Transverse bores 308 and 310 intersecting the axial bore 302 are disposed in spaced relation substantially opposite to the ends of the shuttle meter bores 260 and 260′. The bore 308 is disposed at 90° to the bore 310. The bores 308 and 310 open into generally oval shaped slots 308′ and 310′ in the cylindrical surface of the distributor. The slots 308′ are adapted to alternately communicate with ports 312 and 314 in the upper housing section 70*a*, the port 312 leading into the left end of the bore 262 and the port 314 leading into the left end of the bore 262′. Similarly, the slots 310′ are adapted to communicate with ports 316 and 318 which respectively open into the cavities 294 and 294′ at the right end of bores 262 and 262′. The ports 312 and 314 are not in aligned relation and accordingly do not communicate at the same time with the transverse bore 308 in the distributor. Similarly, the ports 316 and 318 are not in alignment and do not simultaneously communicate with bore 310 of the distributor.

The fuel flowing from the low pressure pump 40 through the final filter 32 into passage 44 accordingly passes through passage 307 into distributor annulus 304, transverse passage 306 and axial bore 302. The fuel then flows alternately through passages 308 and 310 and slots 308' and 310' through the ports 312, 314, 316 and 318 into the communicating shuttle meter assembly bores. Such fuel flow serves the dual purpose of alternately advancing the shuttles within the bores to pump fuel from one end thereof and to charge the opposite end of the bore with a metered fuel quantity which is distributed on the return stroke of the shuttle. This operation of the shuttles and the manner in which the fuel quantity is metered will be considered in detail following a description of the distribution passages in the housing and distributor 250.

The distributor 250 in addition to its function of alternately supplying fuel to opposite ends of the shuttle meter bores, distributes the fuel from the shuttle meter assemblies to the passages 300*a–h*. Annuli 320, 322, 324 and 326 of the distributor 250 respectively communicate with ports 328, 330, 332 and 334 of the upper housing section 70*a*. The ports 328 and 332 open into the bore 262 of the shuttle meter assembly 260 while the ports 330 and 334 open into the bore 262' of the shuttle meter assembly 260'. Axial slots 320', 322', 324' and 326' in the distributor 250 communicate respectively with the annuli 320, 322, 324 and 326. The slots 320', 322', 324' and 326' are disposed so as to respectively communicate alternately with the passages 300*a* or 300*h*, 300*b* or 300*g*, 300*c* or 300*f*, and 300*d* or 300*e*. The slots 320', 322', 324' and 326' are circumferentially staggered to coincide with the pumping movement of the shuttle sleeves 272 and to sequentially deliver the metered fuel output of the shuttle sleeves in the proper sequence to the passages 300*a–h*. The manner in which the fuel metering and distribution takes place will be evident from a study of the fuel delivery positions shown in FIGS. 12 and 13.

Figure 12:
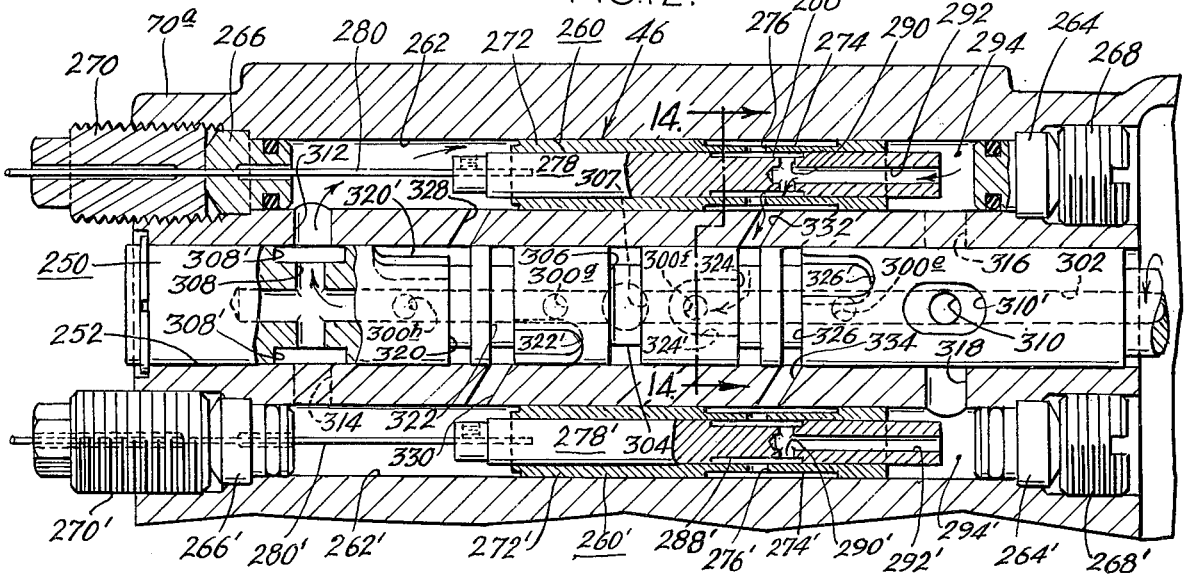
FIG. 12 is an enlarged partial view of the fuel metering and distributing means as shown in FIG. 2 but with the movable elements thereof in different positions.

In FIG. 12, fuel is entering the lefthand end of the bore 262 from the distributor bore 302, bore 308, slot 308', and port 312. This pressurized fuel moves the shuttle sleeve 272 to the right, thereby forcing fule in the cavvity 294 into the control piston bore 292, slot 290 and annulus 288, through port 276 and annulus 274 of the shuttle sleeve, through port 332 into annulus 324 and slot 324' and into passage 300*f* from which it passes into one of the injectors. The stroke of the shuttle sleeve 272, which in FIG. 12 is shown in a mid-stroke position, ends when the port 276 thereof passes out of communication with the annulus 288 of the control piston (the position of the shuttle sleeve 272 shown in FIG. 13). The fuel acting to propel the shuttle sleeve 272 to the right will serve as the metered fuel charge to be delivered to an injector upon the leftward movement of the shuttle sleeve 272 which takes place when one of the slots 310' of the distributor aligns with the port 316. The metering of the fuel is dependent upon the position of the control sleeve 278 and the further to the right the control sleeve is located, the greater the travel of the shuttle sleeve and hence the more fuel displaced by the shuttle stroke.

Figure 13:
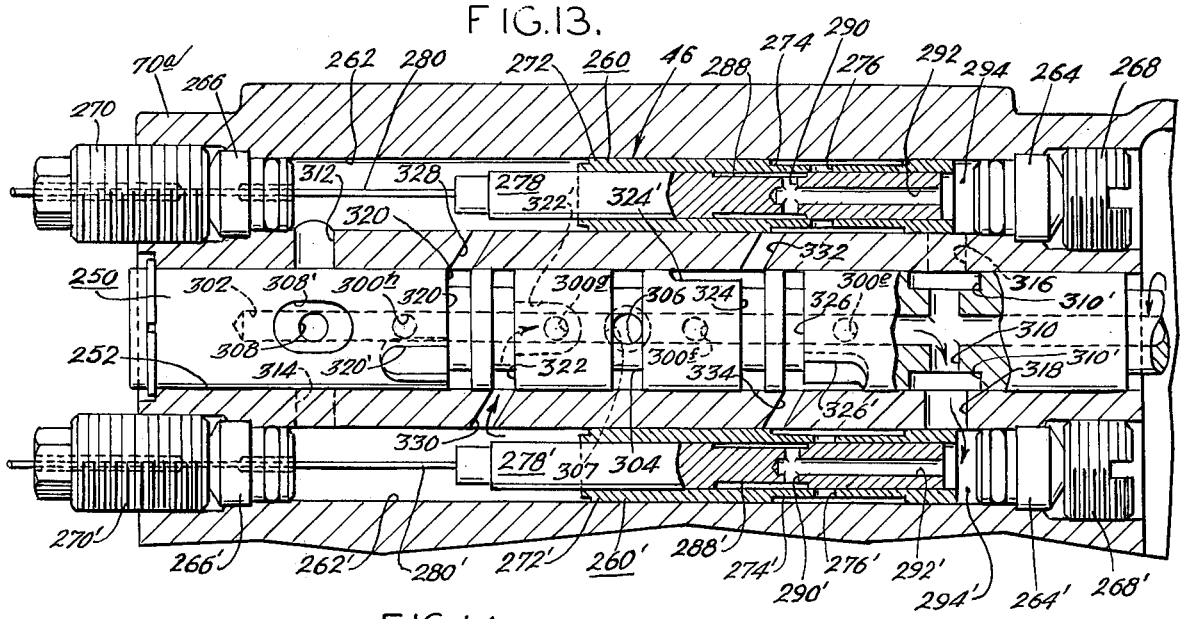
FIG. 13 is a view as in FIG. 12 with the metering shuttles and distributor shown in different positions.
Figure 14:
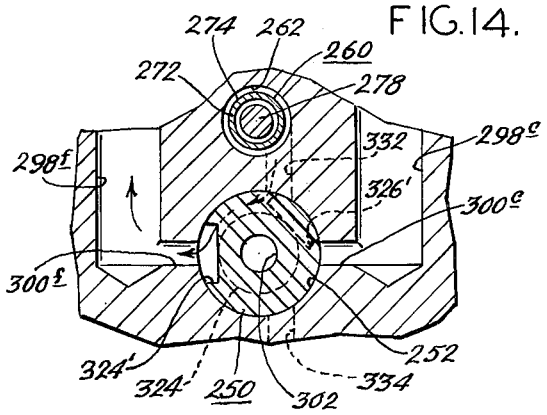
FIG. 14 is a partial sectional view taken along line 14—14 of FIG. 12.

A further example of the metering and distributing operation is shown in FIG. 13 wherein the distributor 250 is rotated 90° from the position shown in FIG. 12. In the distributor position of FIG. 13, the distributor bore 310 and slot 310' are in communication with the port 318, and thus are starting to deliver pressurized fuel into cavity 294' to advance shuttle 272' to the left, thereby metering out the quantity of fuel present in the left end of the bore 262' through the port 330 into annulus 322, through slot 322' into passage 300*g*. The distribution will terminate upon passage of the lefthand end of the shuttle sleeve 272' past the port 330. The port 314 is of course blocked during the shuttle stroke since the passage 308 and slot 308' of the distributor is rotated 90° out of phase. Although the annulus 274' and port 276' of the shuttle sleeve 272' will communicate with the annulus 288' of control piston 278' during the shuttle stroke, there will be no flow through the port 334 into annulus 326 since the slot 326' will not be in communication with either the passage 300*d* or the passage 300*e*.

From the foregoing it can be understood that the reciprocation of the shuttle sleeves 272 and 272' provides a metering of the fuel which is then distributed sequentially into the passages 300*a–h* by the above-described distributor passages. The fuel quantity delivered is determined by the position of the control pistons 278 and 278' which as indicated are moved axially by the movement of the yoke 234 upon rotation of the shaft 230 as required by the governor control rod 228. The clockwise rotation of the shaft 230 signalling a need for increased fuel delivery rotates the yoke 234 in a clockwise manner, thus advancing the control wires 280 and 280' to the right as viewed in FIG. 2 to move the control pistons 278 and 278' to the right. As described above, this increases the length of the shuttle stroke in each direction and accordingly the fuel displaced by the shuttle stroke into the injectors. Conversely, a counterclockwise rotation of shaft 230 signalling a need for decreased fuel delivery moves the control pistons to the left and shortens the stroke of the shuttle sleeves, thereby diminishing the amount of fuel delivered in each charge.

By means of the screws 282 and 282', the effective length of the control wires 280 and 280' can be accurately adjusted to insure the same amount of fuel delivery from each of the shuttle meter assemblies 260 and 260'.

Means are provided for coordinating the timing of the fuel injection electrically in a manner similar to that described in U.S. Pat. No. 3,587,535, assigned with the present application to a common assignee, which is hereby incorporated by reference. This timing means in the illustrated embodiment is enclosed within an auxiliary housing 340 as shown in FIG. 2 which is attached at one end of the upper housing section 70*a*. The timing means includes a shutter 342 mounted for rotation on an extension 344 of the distributor 250 by a nut 346. The shutter 342 includes an aperture 348 in a cylindrical surface thereof through which light from a light sources 350 passes to photosensitive detectors 352 to produce an electric current at the moment of the aperture passage. The light sources 250 and the photosensitive detectors 352 are mounted in spaced relation on a carriage 354 secured in position on the auxiliary housing 340 by a bolt 356 and nut 358.

The timing arrangement illustrated is of a somewhat simpler form than that illustrated in U.S. Pat. No. 3,587,535 although the basic function is the same, the current generated by passage of the light beam through the aperture 348 producing an electric current in the associated photosensitive device, which current is by way of appropriate electrical circuitry utilized to excite the associated injector solenoid coil to initiate injection. In the patented timing device, means are provided for advancing or retarding the timing as a function of engine speed and load whereas in the present device the timing adjustment is manually set by varying the rotational position of carriage 354 on the housing 340. Automatic timing adjustment may be included either in the manner shown in Pat. 3,587,535, or by utilizing electronic timing adjustment means in conjunction with the basic arrangement illustrated in FIG. 2.

Inasmuch as the operation of the specific elements of the controller has been described in the course of the above description, only a general operational summary appears necessary to tie together the overall controller operation.

For operation, the controller is mounted on an engine with the main shaft 74 connected by suitable gearing to the engine for rotation therewith at one half engine speed. The shaft 86 and fuel control rod 228 are conected to the governor. The fuel input from the tank is connected at passage 38 and the conduits 24 are joined to the ports 296*a–h*. The common rail conduit 22 is connected to the output passage 142 of the piston pump 56, and the timing device is connected with the appropriate electrical circuitry to signal the injection timing in phase with the engine operation.

During operation of the controller, the rotation of the main shaft 74 at one half engine speed drives the gear pump 40 to produce a steady flow of low pressure fuel to the regulator 52 and to the distributor 250. The regulator 52 senses the common rail pressure output of piston pump 56 by means of differential pistons 58 and 60 and provides a regulated low pressure input to the piston pump 56 in accordance with the engine load as established by the position of regulator piston 214. Should the pressure output of pump 56 fall below the desired level established by the position of regulating piston 214, the force of the spring 64 will be greater than the force on lever 62 provided by the differential pistons 58 and 60 and the lever will rotate to move the regulator sleeve 192 to the right as shown in FIG. 8, thereby opening the passage between the port 208 and annulus 216 permitting an increased flow of fuel through passage 54 into piston pump 56. The increased fuel input into piston pump 56 results in an increased pump output pressure which in turn will act upon the regulator differential pistons to balance the force of spring 64, returning the regulator sleeve 192 back to a balanced position with respect to regulator piston 214.

As indicated above, a decrease in load as signalled by the governor fuel demand will result in the movement of the regulator piston 124 to the right, thereby cutting back the fuel delivery to piston pump 56 and accordingly diminishing the rail pressure output. An increase in fuel demand will by virtue of the cam contour 238 cause a movement of the regulating piston 214 to the left, thereby causing an increased flow through the regulator and hence an increase in the piston pump output pressure.

An important feature of the disclosed regulator construction is the low force signal required to position the regulating piston 214 due to its completely balanced loading. The only axial pressures to which the piston is subjected are those present within the annulus 216 and these are completely balanced by the identical areas of the opposed piston lands. The piston actuating forces are therefore very low and easily handled by the thin wire 222 despite the fact that the regulated pump output pressure may be as high as 3,000 psi. Similarly, by proper selection of the diameters of the differential pistons 58 and 60, the required force of spring 64 may be quite low, for example 10 pounds.

The operation of the piston pump 56 has been fully described above and further description would be only repetitive. In summary, the output of the piston pump 56 is wholly dependent on the input provided by regulator 52 and could drop briefly to zero delivery should the regulator so dictate.

The operation of the fuel metering and distribuiting apparatus has also been discussed in considerable detail above. It should be mentioned that the control piston 278 and 278' are substantially balanced by the presentce of the shuttle sleeve 272 and 272' which are always free to move to correct any imbalance that may develop between the fuel pressures in opposite ends of the bores 262 and 262'. There is accordingly little force required to axially position the control pistons and the wires 280 and 280' are completely adequate for this purpose.

Should the distributing and metering device illustrated be utilized with a two cycle engine, it will be necessary to drive the distributor to provide rotation at engine speed rather than at one half engine speed as in the illustrated four cycle engine embodiment.

Manifestly, changes in details of construction can be effected by those skilled in the art without departing from the spirit and scope of the invention.

I claim

1. A controller for a diesel engine fuel injection system having an injector for each engine cylinder actuated by a variable high pressure fuel common rail, said controller including fuel metering and distributing means for deliverying metered quantities of fuel to said injectors, a high pressure fuel pump for supplying said variable common rail pressure, said common rail output pressure of said pump varying with the fuel input flow thereto, a regulator for regulating the output pressure of said high pressure pump in accordance with engine load, and a low pressure fuel pump for delivering fuel from a fuel supply source to said fuel metering and distributing means and to said regulator for passage into said high pressure pump, said regulator being adapted to sense said common rail output pressure of said high pressure pump and to regulate the flow of fuel into said high pressure pump to thereby vary said common rail output pressure as a function of engine load, said regulator including a regulator sleeve slidably disposed for axial movement within a cylindrical bore, a regulator piston disposed within said sleeve, passage means cooperatively arranged within said regulator sleeve and piston defining a variable orifice for regulating fuel flow through said regulator to said high pressure pump, means for positioning said sleeve within said bore as a function of said high pressure pump common rail output pressure, said latter means comprising differential piston means, and means for positioning said regulator piston within said bore as a function of engine load, whereby the size of said variable orifice is increased or decreased as required to maintain the high pressure pump common rail output pressure at a predetermined level in accordance with engine load.

2. The invention as claimed in claim 1 wherein said regulator comprises a centrally pivotally mounted lever connected at one end to said regulator sleeve, said differential area piston means comprising differential area pistons disposed in cylinders and acting on the other end of said lever, conduit means for introducing said high pressure pump common rail fuel pressure to opposing ends of said differential area pistons, and spring means acting on said lever in opposition to the force produced thereon by said differential area pistons.

3. The invention as claimed in claim 1 wherein said means for positioning said regulator piston comprises a mechanical linkage connecting said piston for motion with the governor fuel control rod.

4. The invention as claimed in claim 3 wherein said linkage includes a thin wire attached to said piston and extending from said bore.

5. The invention as claimed in claim 3 wherein said linkage comprises a cam surface and a cam follower in engagement with said cam surface, the configuration of said cam surface providing a predetermined variation of the common rail pressure with variation in engine load.

6. The invention as claimed in claim 1 wherein said regulator sleeve comprises a radial port communicating externally with conduit means delivering fuel from said low pressure pump, said regulator piston comprising an annulus adapted for communication with said sleeve port to form said variable orifice, said piston annulus communicating with conduit means for delivering fuel passing therethrough to said high pressure pump.

7. The invention as claimed in claim 1 wherein said high pressure fuel pump comprises a cylindrical pump housing, a plurality of cylinders radially disposed within said housing, a piston slidably disposed within each of said cylinders, a tappet and roller associated with each piston, a cam rotatably disposed for rotation around said pump housing, cam surfaces on said cam adapted to engage said rollers to drive said pistons radially inwardly within said cylinders means for rotating said cam, and means including check valve means for delivering fuel to said cylinders and for removing the pumped fuel therefrom.

8. The invention as claimed in claim 7 wherein said cylinders are disposed at uniformly spaced angular intervals within said housing and wherein said cam surface contour comprises repetitive configurations equal or multiple in number to the number of pump cylinders whereby all of the pistons contained within the housing are driven radially inwardly at the same time.

9. The invention as claimed in claim 8 including a check valve intermediate said regulator and said high pressure pump, a common compression chamber communicating with said pump cylinders, conduit means connecting said check valve with said compression chamber, conduit means for connecting said compression chamber with said regulator differential piston means and said injector common rail, and a check valve in said latter conduit means.

10. The invention as claimed in claim 1 wherein said fuel metering and distributing means comprises a metering shuttle assembly including a housing having a cylindrical bore therein, a shuttle sleeve slidably disposed within said bore, a control piston disposed within said sleeve in relative slidable relation with respect thereto, means for closing the ends of said bore to form chambers at each end thereof between said closing means and said shuttle sleeve and control piston, means for controlling the axial position of said control piston in accordance with engine load, means for alternately introducing fuel under pressure into said chambers to cause a recipricatory movement of said shuttle sleeve, a distributor port communicating with each of said chambers, and passage means in said control piston and said shuttle sleeve cooperating to limit the travel of said shuttle sleeve in one direction by blocking fuel flow through one of said distributor ports, said shuttle sleeve blocking the other of said distributor ports to terminate the stroke of siad shuttle sleeve in the other direction.

11. The invention as claimed in claim 10 wherein said means for controlling the axial position of said control piston comprises a thin wire connected to one end thereof passing axially from said housing bore, said wire being connected to the engine governor fuel control rod.

12. The invention as claimed in claim 10 wherein said passage means in said control and said shuttle sleeve comprise an axial bore in said control piston communicating with a transverse bore and an annulus therein, said shuttle sleeve including an external annulus having a transverse port communicating therewith, said control piston annulus and said shuttle sleeve port when in communication permitting a flow of fuel from the chamber adjacent said control piston bore into one of said distributor ports.

13. The invention as claimed in claim 10 wherein said means for alternately introducing fuel into said chambers comprises a rotary distributor, ports connecting said chambers with said rotary distributor, and passage means in said rotary distributor adapted to alternately communicate with said ports to introduce fuel thereinto, said distributor including passage means adapted to selectively connect said distributor ports with the engine injectors.

* * * * *